US010975859B2

(12) United States Patent
Bica Caffera

(10) Patent No.: US 10,975,859 B2
(45) Date of Patent: Apr. 13, 2021

(54) METHOD FOR SELF-ADJUSTMENT OF A PUMP SETTINGS IN A SWIMMING POOL FILTERING CIRCUIT

(71) Applicants: GIDELMAR, S.A., Montevideo (UY); MIDTAL TALENTOS, S.L., Banyoles (ES)

(72) Inventor: Gabriel Alejandro Bica Caffera, Montevideo (UY)

(73) Assignees: GIDELMAR, S.A., Montevideo (UY); MIDTAL TALENTOS, S.L., Banyoles (ES)

( * ) Notice: Subject to any disclaimer, the term of this patent is extended or adjusted under 35 U.S.C. 154(b) by 249 days.

(21) Appl. No.: 15/760,350

(22) PCT Filed: Oct. 9, 2015

(86) PCT No.: PCT/EP2015/073354
§ 371 (c)(1),
(2) Date: Mar. 15, 2018

(87) PCT Pub. No.: WO2017/059921
PCT Pub. Date: Apr. 13, 2017

(65) Prior Publication Data

US 2018/0258925 A1 Sep. 13, 2018

(51) Int. Cl.
*F04B 49/06* (2006.01)
*F04B 17/03* (2006.01)
(Continued)

(52) U.S. Cl.
CPC ..... *F04B 49/06* (2013.01); *F04B 15/00* (2013.01); *F04B 17/03* (2013.01); *F04B 19/04* (2013.01);
(Continued)

(58) Field of Classification Search
CPC ..... F04B 49/06; F04B 15/00; F04B 17/03; F04B 19/04; F04B 53/20; F04B 2205/09;
(Continued)

(56) References Cited

U.S. PATENT DOCUMENTS

2002/0061271 A1* 5/2002 Zauderer ..... B01D 53/502 423/243.08
2005/0194326 A1* 9/2005 Calabrese ..... B01D 29/01 210/798
(Continued)

FOREIGN PATENT DOCUMENTS

EP 1 790 858 A1 5/2007

OTHER PUBLICATIONS

International Preliminary Report on Patentability issued in PCT/EP2015/073354 dated Nov. 17, 2017.
(Continued)

*Primary Examiner* — Connor J Tremarche
(74) *Attorney, Agent, or Firm* — Arent Fox, LLP

(57) ABSTRACT

The proposed method includes an initial checking step, during which a pump of a filtering circuit is operated at a given checking operation frequency meanwhile a pump checking operation value is measured, and using the measured data a calculation of the water flow rate when pump operates at a given operation frequency lower than the given checking operation frequency is performed. The pump is then operated at said given operation frequency for a first filtering period of time. When said period is concluded the checking step, at checking frequency, is newly performed obtaining a new checking operation value, and this value is used to calculate a required operation frequency necessary to produce a flow rate equal to the initially calculated flow rate, and the pump is operated at said new calculated operation frequency for a second filtering period of time.

9 Claims, 2 Drawing Sheets

(51) Int. Cl.

| | |
|---|---|
| ***F04B 15/00*** | (2006.01) |
| ***F04B 19/04*** | (2006.01) |
| ***F04B 53/20*** | (2006.01) |
| ***F04D 15/00*** | (2006.01) |
| ***F04D 29/70*** | (2006.01) |
| *E04H 4/12* | (2006.01) |

(52) U.S. Cl.
CPC ..... *F04B 53/20* (2013.01); *F04D 15/0066* (2013.01); *F04D 15/0088* (2013.01); *F04D 29/708* (2013.01); *E04H 4/1245* (2013.01); *F04B 2205/09* (2013.01)

(58) Field of Classification Search
CPC ..... F04D 15/0066; F04D 15/0088; F04D 29/708; E04H 4/1245
USPC ..... 417/45
See application file for complete search history.

(56) References Cited

U.S. PATENT DOCUMENTS

2007/0154319 A1* 7/2007 Stiles, Jr. ..... F04B 49/20 417/42
2007/0154320 A1* 7/2007 Stiles, Jr. ..... F04B 49/20 417/43
2007/0163929 A1* 7/2007 Stiles, Jr. ..... F04B 49/20 210/97

OTHER PUBLICATIONS

International Search Report and Written Opinion issued in PCT/EP2015/073354 dated Jun. 27, 2016.

* cited by examiner

METHOD FOR SELF-ADJUSTMENT OF A PUMP SETTINGS IN A SWIMMING POOL FILTERING CIRCUIT

CROSS-REFERENCE TO RELATED APPLICATION

This application is a National Stage entry of International Application No.: PCT/EP2015/073354, filed Oct. 9, 2015. The disclosure of the priority application is hereby incorporated in its entirety by reference.

FIELD OF THE ART

The present invention relates to the field of the self-adjustment of a pump settings in a swimming pool filtering circuit including a pool, a filter, and a centrifugal electrical pump with either an integral or external electronic frequency converter the pump constantly circulating water through the closed water circuit at a flow rate, but when a cleaning operation or change of a filter occurs.

The proposed method includes an initial checking step, during which a pump of a filtering circuit is operated at a given checking operation frequency meanwhile a pump checking operation value is measured, and using the measured data a calculation of the water flow rate when pump operates at a given operation frequency lower than the given checking operation frequency is performed. The pump is then operated at said given operation frequency for a first filtering period of time. When said period is concluded the checking step, at checking frequency, is newly performed obtaining a new checking operation value, and this value is used to calculate a required operation frequency necessary to produce a flow rate equal to the initially calculated flow rate, and the pump is operated at said new calculated operation frequency for a second filtering period of time. When said second filtering period of time is concluded checking step, calculation and pump operation during a second filtering period of time is iteratively performed until the checking operation value exceeds a given threshold, triggering an event.

STATE OF THE ART

EP 1630422 discloses a variable pumping system for moving water on an aquatic application including a water pump a variable speed motor a filter arrangement and a sensor operatively connected with the filter arrangement for sensing a parameter of the operation associated with the filter arrangement and a controller for controlling speed of the motor in response to the sensed parameter of operation.

U.S. Pat. No. 8,480,373 discloses a pumping system for moving water of a swimming pool including a water pump, a variable speed motor and a filter arrangement on fluid communication with the pump, the pumping system including means for determining a load value indicative of an unclogged filter that permits movement of water through the filter arrangement.

US 2012/0073040 discloses a safety vacuum release system which incorporates a water flow rate sensor in electrical communication with the electric motor which powers a swimming pool pump at an aquatic facility detecting a flow blockage situation.

WO 2015/061015 discloses a system and method for circulating water of swimming pools, including a main filtration pump and a secondary booster pump with the booster pump containing a variable-speed motor. By adjusting the motor speed of the booster pump, pressurized water may be supplied to certain automatic swimming pool cleaners more efficiently.

US20070154320 discloses a pumping system including a pump connected to a motor, a filter and a pool in which the motor speed produces a flow rate of the pumped fluid through the filter, and in which the flow rate of said fluid is maintained constant increasing the motor speed when the filter becomes dirty. According to this document the energy consumption of the motor can be considered a performance value indicative of the flow rate of the pumped fluid, and this performance value can be used to calculate an adjustment value such as a new motor speed needed to maintain the flow rate constant despite the dirty accumulated on the filter.

Document US20070154320 only describe the use of a operation frequency adapted to provide constant flow rates during different periods of time depending on the cleaning necessities or adapted to achieve a predetermined volume of water flow in a period of time.

The invention proposes a different strategy for controlling the pump setting in manner to keep a constant flow rate until the filter reaches a point of close to saturation.

BRIEF DESCRIPTION OF THE INVENTION

The present invention relates to a method for self-adjustment of a pump settings in a swimming pool filtering circuit comprising a closed water circuit through which the water is constantly circulated except when a cleaning operation or change of a filter occurs.

Said filtering circuit includes a pool, a filter and a centrifugal electrical pump with either an integral or external electronic frequency converter, said centrifugal electrical pump constantly circulating water through the closed water circuit at a given flow rate.

So, said pump draws water through a conduit connected to the pool, and forced through a filter, for example a sand filter, which partially clean said pumped water from the pool retaining some particles or contaminants. The filtered water is extracted from the filter and returned to the pool by means of conduction.

The proposed method includes performing following steps:

a) calculate a flow rate (QN1*i*) produced operating the pump (2) at a predefined operation frequency (N1), and operate the pump (2) at said predefined operation frequency (N1) during a first filtering period of time (T1); after concluding said filtering period of time (T1), b) calculate a pump operation frequency (Nn) necessary to pump water at said flow rate (QN1*i*); and operate the pump (2) at said calculated pump operation frequency (Nn) during a second filtering period of time (T2).

In a novel manner the method further comprises:

c) previous to said step a), operate the pump (2) at a predefined checking frequency (N) during a checking period of time (Tc), being the filter at an initial cleanness state and being the operation frequency (N1) lower than the checking frequency (N), producing a checking flow rate (Q50*i*); measure a pump checking operation value (I) during said checking period of time (Tc) and use said measured pump checking operation value (I) to perform the calculation of step a);

d) after concluding said first filtering period of time (T1) operate the pump (2) at said predefined checking frequency (N) during a checking period of time (Tc) producing a checking flow rate (Q50*i*); measure a new pump checking operation value (I) during said checking period of time (Tc); and use said measured new pump checking operation value (I) to perform the calculation of step b), after concluding said second filtering period of time steps b) and d) are repeated iteratively, obtaining different checking operation values on each iteration due to the fact that the filter offers as time goes on an increasing resistance to the flow, and therefore calculating different pump operation frequency on each iteration to keep said flow rate calculated on step a) constant, and generating an event when said checking operation value measured on step d) exceed a given threshold.

So according to this method, in an initial step when the filter is at an initial cleanness state, which will be preferably a clean state of a new filter or a clean state of a cleaned filter, the pump is operated at a given checking frequency during a checking period of time pumping water from the swimming pool through said filtering circuit at a checking flow rate. During said checking period of time a pump checking operation value is measured.

Preferably said measurement is performed by an automatic sensor which is connected to a PLC (programmable logic controller), to a computer, to a local or remote controller device, or to any other programmable electronic device.

Said checking operation values measured can be any kind of values which provide information direct or indirectly related with the pumped water flow rate. An example of said pump checking operation value can be, in a illustrative and non-limitative example, the current intensity consumed by the pump, which provides information related with the amount of work performed by the electric motor of the pump to force the water through the filter, which is an information from which the water flow rate can be calculated, based in some formulas, tables or conversion values provided for example by empiric measurements and stored on said PLC, or other programmable electronic device.

This initial pump checking operation value provides information about the initial resistance in front to the water flow offered by the filtering circuit including the filter at an initial cleanness state.

Using said pump checking operation values a calculation of the flow rate produced operating the pump at a predefined operation frequency is performed, for example by said PLC or said programmable electronic device, and then after the checking period of time the pump stops operating at the checking frequency and operates at the predefined operation frequency during a first filtering period of time.

When said first filtering period of time is completed, step d) is performed, operating the pump at the pump checking frequency and measuring a new checking operation value. After that using said checking operation value a calculation of a pump operation frequency necessary to produce a flow rate equal than the flow rate initially calculated, and said calculated operation frequency is used as a new operation setting for operating the pump during a second filtering period of time, producing an efficient filtration of the water at a predefined flow rate.

During said first and second filtering period of time the filter retain particles and contaminants, increasing the resistance in front to the flow rate offered by said filter and therefore producing a decreasing flow rate at a constant operation frequency of the pump.

The ideal and more efficient operation frequency is typically a low frequency which makes difficult the detections of variations in the operation values with precision enough to allow the calculation of a corrected pump operation frequency necessary to maintain a constant flow rate despite the increase of the resistance on front of the flow rate offered by said filter. Therefore after the conclusion of the second filtering period of time the steps b) and d) of the method are repeated iteratively multiple times. On each iteration the filter cleanness state is worst because the initial cleanness state corresponds to the final cleanness state of the filter after performing previous filtering operations, and therefore not being a clean filter. The resistance offered by said filter in front to the flow is bigger on each iteration, therefore the pump operation frequency calculated on each iteration to obtain a constant flow rate should be also higher on each iteration.

Step d) produces an increase of the pump frequency, and an increase of the flow rate, producing measureable differences between the new checking operation values measured on each iteration, which cannot be measured operating at the operating frequency, allowing a precise calculation of the required pump operation frequency necessary to maintain the flow rate constant, being the pump operation frequency calculated on each iteration higher than in previous iteration.

At some point the checking operation values measured during step d) will exceed a given threshold, and then an event is performed. Said event can be, for example, the interruption of the pump operation, the creation of an alarm signal or the implementation of an automatic filter cleaning process.

According a preferred embodiment, said checking operation value is the current intensity consumed by the pump.

As an example, said pump operation frequency can be comprised between 15 and 25 Hz and said pump checking frequency can be comprised between 40 and 50 Hz, but preferably said predefined pump operation frequency is 20 Hz.

Said checking period of time can be between 30 seconds and 5 minutes, and said first, second and successive operation period of time can be between 20 and 120 minutes.

In a preferred embodiment said filter is a sand filter.

Other details of the invention will be shown in the following detailed description of an embodiment.

BRIEF DESCRIPTION OF THE DRAWINGS

The foregoing and other advantages and features will be more clearly understood based on the following detailed description of an embodiment in reference to the attached drawings which must be interpreted in an illustrative and non-limiting manner, in which.

DETAILED DESCRIPTION OF AN EMBODIMENT

Figure 1:
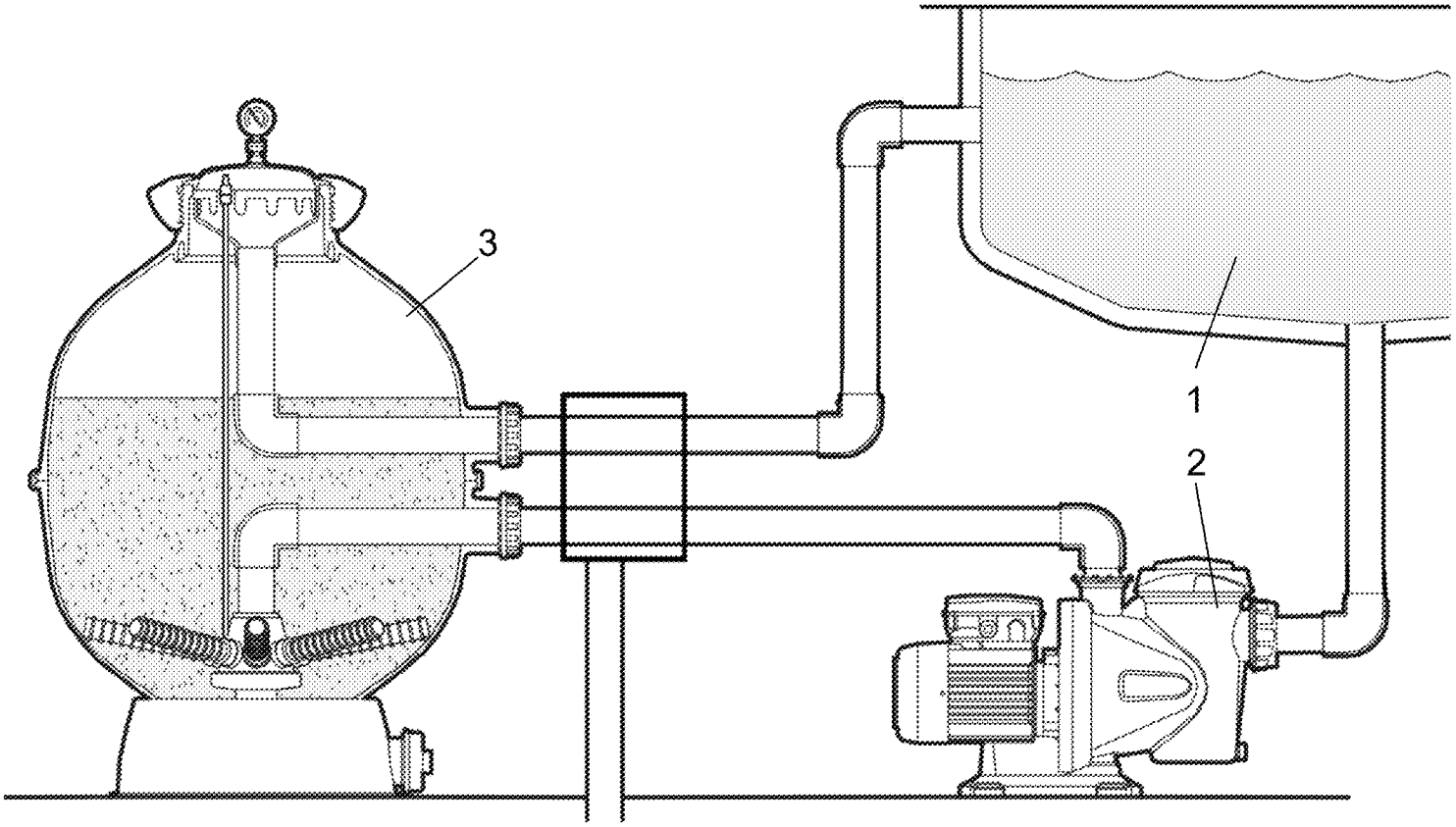
FIG. 1 shows a schematic sectional view of a swimming pool filtering circuit including a pool, a filter, and a centrifugal electrical pump with either an integral or external electronic frequency converter that constantly circulates water through the closed water circuit at a given flow rate.

FIG. 1 shows by way of non-limiting illustrative example a method for self-adjustment of a pump settings in a swimming pool filtering circuit.

The proposed filtering circuit comprises a closed water circuit through which the water is constantly circulated but when a cleaning operation or change of a filter 3 occurs, including a swimming pool 1, a sand filter 3 and a multistage centrifugal pump 2 activated by an electric motor and controlled by an integral or external electronic frequency converter.

The filtering circuit includes a first pipe connecting said swimming pool 1 with the pump inlet, a second pipe connecting the pump outlet with the filter inlet, and a third pipe connecting the filter outlet with the swimming pool 1. An additional dumping pipe can be connected to the second or third pipes through a valve, permitting dumping water from the circuit.

The proposed method starts with an initial step c), during which the pump 2 is operated during a checking period of time Tc at a checking frequency N of 50 Hz, absorbing water from the swimming pool 1 through said first pipe, forcing said water through the sand filter 3, which is at an initial cleanness state, and returning the filtered water to the swimming pool 1 through the third pipe.

Said initial step c) is performed through a clean or new filter 3 having optimal initial cleanness state, and being said checking period of time Tc 3 minutes long.

The current intensity consumed by the electric motor of the pump during said checking period of time Tc, called on this embodiment pump checking operation value I, is measured by a sensor integrated on the electronic frequency converter connected to the electric motor of the pump 2. Said data are communicated to a PLC also integrated on said electronic frequency converter, which store a function which allows said PLC to calculate during step a) the flow rate Q50*i* produced by said pump 2 operated at the predefined checking frequency N of 50 Hz and consuming the measured current intensity consumed, and using said flow rate Q50*i* calculated the PLC can calculate the flow rate QN1*i* produced operating the pump at any other operation frequency different to the checking operation frequency. Also during step a) said PLC calculates the flow rate QN1*i* produced by the pump 2 operating at a predefined operation frequency N1 stored on the PLC memory, in this example 20 Hz, which is a preferred efficient operation frequency, and stores the calculated flow rate QN1*i* on the PLC memory.

Next the pump 2 is operated at said predefined operation frequency N1 of 20 Hz during a first filtering period of time T1 (for example 1 hour) during the step a) of the method.

When said first filtering period of time N1 concludes the sand filter 3 will offer an increased resistance to the flow of water through it, and therefore the flow rate at the end of said first filtering period of time will be lower than the flow rate at the beginning of said first filtering period of time.

At this point, step a) is concluded and step d) is performed operating the pump at the checking operation frequency N (50 Hz) during said checking period of time Tc (3 minutes), producing the increase of the flow rate and also the increase of the checking operation value I (current intensity consumed) to a higher level compared with the operation value during said first filtering period of time T1 allowing a precise measuring of said checking operation value I. Using this data and during step b) said PLC calculates a new operation frequency Nn necessary to produce a flow rate equal than the initial calculated flow rate QN1*i* stored on the PLC memory.

Next the pump 2 is operated at said new calculated operation frequency Nn during a second filtering period of time T2 performing step b), producing a flow rate equal than the flow rate QN1*i* produced during the first filtering period of time T1.

When said second filtering period of time T2 has ended, the steps b) and d) of said method are repeated iteratively, being the initial cleanness of the filter 3 worst on each iteration, producing a reduction of the flow rate on each iteration, and requiring a higher operation frequency Nn on each iteration.

This method is reproduced multiple times until the checking operation value I exceeds a predefined threshold, and then an event is triggered.

Said event will be preferably stopping the pump, or creating an alarm signal, or implementing a filter cleaning operation, for example a backwash operation.

Different frequencies and times are also contemplated.

Figure 2:
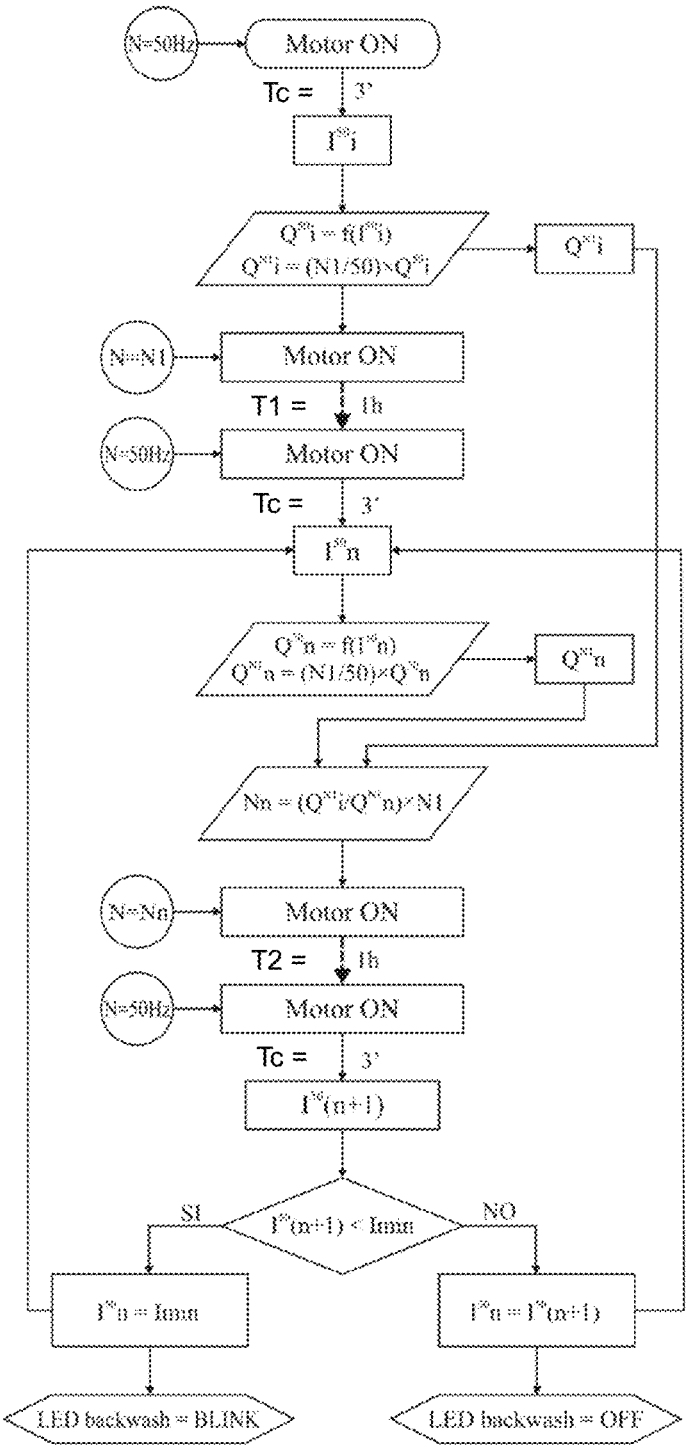
FIG. 2 shows schematic flow chart of the operation method described.

FIG. 2 shows a schematic flow chart of the operation method described wherein letter N represents the pump operation frequency, letter I represents the pump operation value, and letter Q represents the flow rate value.

The invention claimed is:

1. Method for self-adjustment of a pump settings in a swimming pool filtering circuit, comprising a closed water circuit through which the water is constantly circulated except when a cleaning operation or change of a filter occurs, said pool filtering circuit including:

a pool;

a filter;

a centrifugal electrical pump with either an integral or external electronic frequency converter, said centrifugal electrical pump constantly circulating water through the closed water circuit;

the method comprises following steps performed in following order:

a) calculate a flow rate produced operating the pump at a predefined operation frequency, and operate the pump at said predefined operation frequency during a first filtering period of time;

after concluding said filtering period of time, b) to calculate a pump operation frequency necessary to pump water at said flow rate; and operate the pump at said calculated pump operation frequency during a second filtering period of time;

characterized in that the method further comprises:

c) previous to said step a), operate the pump at a predefined checking frequency during a checking period of time, being the filter at an initial cleanness state and being the operation frequency lower than the checking frequency, producing a checking flow rate; measure a pump checking operation value during said checking period of time and use said measured pump checking operation value to perform the calculation of step a);

d) after concluding said first filtering period of time operate the pump at said predefined checking frequency during a checking period of time producing a checking flow rate; measure a new pump checking operation value during said checking period of time; and use said measured new pump checking operation value to perform the calculation of step b), after concluding said second filtering period of time steps b) and d) are repeated iteratively, obtaining different checking operation values on each iteration due to the fact that the filter offers as time goes on an increasing resistance to the flow, and therefore calculating different pump operation frequency on each iteration to keep said flow rate calculated on step a) constant, and generating an event when said checking operation value measured on step d) exceed a given threshold.

2. Method according to claim 1, wherein said pump checking operation value and said new checking operation value is the current intensity consumed by the pump.

3. Method according to claim 1, wherein said pump operation frequency is comprised between 15 and 25 Hz and/or said pump checking frequency is comprised between 40 and 50 Hz.

4. Method according to claim 1, wherein said predefined operation frequency is 20 Hz.

5. Method according to claim 1, wherein said filter is a sand filter.

6. Method according to claim 1 wherein said checking period of time is between 30 seconds and 5 minutes.

7. Method according to claim 1 wherein said first and said second filtering period of time are equal.

8. Method according to claim 1 wherein said first and/or second filtering period of time are between 20 and 120 minutes.

9. Method according to claim 1 wherein said event is the creation of an alarm signal.

* * * * *